US009798277B2

(12) United States Patent
Kozuma

(10) Patent No.: US 9,798,277 B2
(45) Date of Patent: Oct. 24, 2017

(54) IMAGE HEATING APPARATUS

(71) Applicant: CANON KABUSHIKI KAISHA, Tokyo (JP)

(72) Inventor: Takeshi Kozuma, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/203,985

(22) Filed: Jul. 7, 2016

(65) Prior Publication Data

US 2017/0010568 A1 Jan. 12, 2017

(30) Foreign Application Priority Data

Jul. 8, 2015 (JP) ..... 2015-136939

(51) Int. Cl.
*G03G 15/20* (2006.01)
*G03G 21/20* (2006.01)

(52) U.S. Cl.
CPC ..... *G03G 15/2028* (2013.01); *G03G 21/206* (2013.01)

(58) Field of Classification Search
CPC ..... G03G 15/2028; G03G 21/206
USPC ..... 399/323
See application file for complete search history.

(56) References Cited

U.S. PATENT DOCUMENTS

2011/0182609 A1* 7/2011 Hasegawa ..... G03G 15/2028 399/94
2011/0206425 A1 8/2011 Seto et al.
2011/0211875 A1* 9/2011 Takeshita ..... G03G 15/2028 399/323
2012/0014725 A1* 1/2012 Seto ..... G03G 15/2028 399/323
2013/0101324 A1* 4/2013 Yamamoto ..... G03G 15/0189 399/323
2014/0153966 A1 6/2014 Tanaka

FOREIGN PATENT DOCUMENTS

JP 60-247672 A 12/1985
JP 2007-094327 A 4/2007

OTHER PUBLICATIONS

Search Report issued in corresponding European Patent Application No. 16176895.7 dated Dec. 21, 2016.

* cited by examiner

*Primary Examiner* — Sandra Brase
(74) *Attorney, Agent, or Firm* — Fitzpatrick, Cella, Harper & Scinto

(57) ABSTRACT

An image heating apparatus includes first and second rotatable members configured to form a nip for heating a toner on a sheet; a compressor; an air nozzle configured to blow air which is compressed by the compressor, to the first rotatable member; and a supplying mechanism configured to supply the air which is compressed by the compressor, to the air nozzle. The supplying mechanism includes a pressure adjusting valve configured to adjust an inside pressure and a metal pipe configured to form at least a part of an air supply passage from the compressor to the pressure adjusting valve.

24 Claims, 5 Drawing Sheets

IMAGE HEATING APPARATUS

FIELD OF THE INVENTION AND RELATED ART

The present invention relates to an image heating apparatus for heating a toner image on a sheet.

This image heating apparatus is usable in image forming apparatuses such as a copying machine, a printer, a facsimile machine and a multi-function machine having a plurality of functions of these machines.

Japanese Laid-Open Patent Application (JP-A) SHO60-247672 and JP-A 2007-094327 disclose that compressed air is blown to a fixing device (image heating apparatus) in order to separate a recording material (sheet) from the fixing device. This is effective in the case where an image is formed on thin paper which is fragile or limp.

A temperature of gas which is taken into a compressor becomes high in a step of generating compressed air. For example, in the case where the air of a normal temperature (25° C.) and a normal pressure (0.1 MPa) is compressed to about 0.4 MPa, a temperature of a resultant gas is about 110° C. to about 120° C.

When such a high-temperature air is caused to flow into a pipe (gas flow passage), a temperature of a pressure adjusting valve provided in a piping passage increases and becomes a generating factor of noise.

SUMMARY OF THE INVENTION

According to an aspect of the present invention, there is provided an image heating apparatus comprising: first and second rotatable members configured to form a nip for heating a toner on a sheet; a compressor; an air nozzle configured to blow air which is compressed by the compressor, to the first rotatable member; and a supplying mechanism configured to supply the air which is compressed by the compressor, to the air nozzle, wherein the supplying mechanism includes a pressure adjusting valve configured to adjust an inside pressure and a metal pipe configured to form at least a part of an air supply passage from the compressor to the pressure adjusting valve.

Further features of the present invention will become apparent from the following description of exemplary embodiments with reference to the attached drawings.

DESCRIPTION OF THE EMBODIMENTS

An embodiment of the present invention will be described below, but the present invention is not limited thereto although the embodiment is an example of a preferred embodiment of the present invention.

<Embodiment>

[Image Forming Apparatus]

Figure 3:
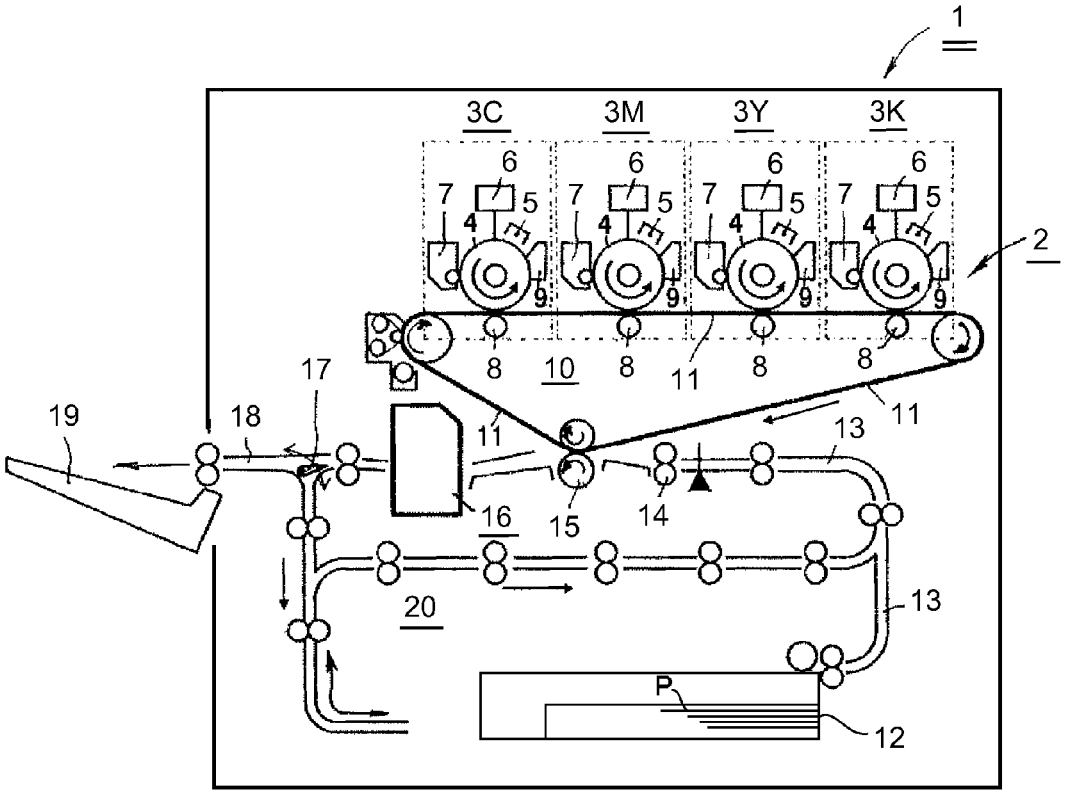
FIG. 3 is an illustration of an image forming apparatus in the embodiment.
Figure 4:
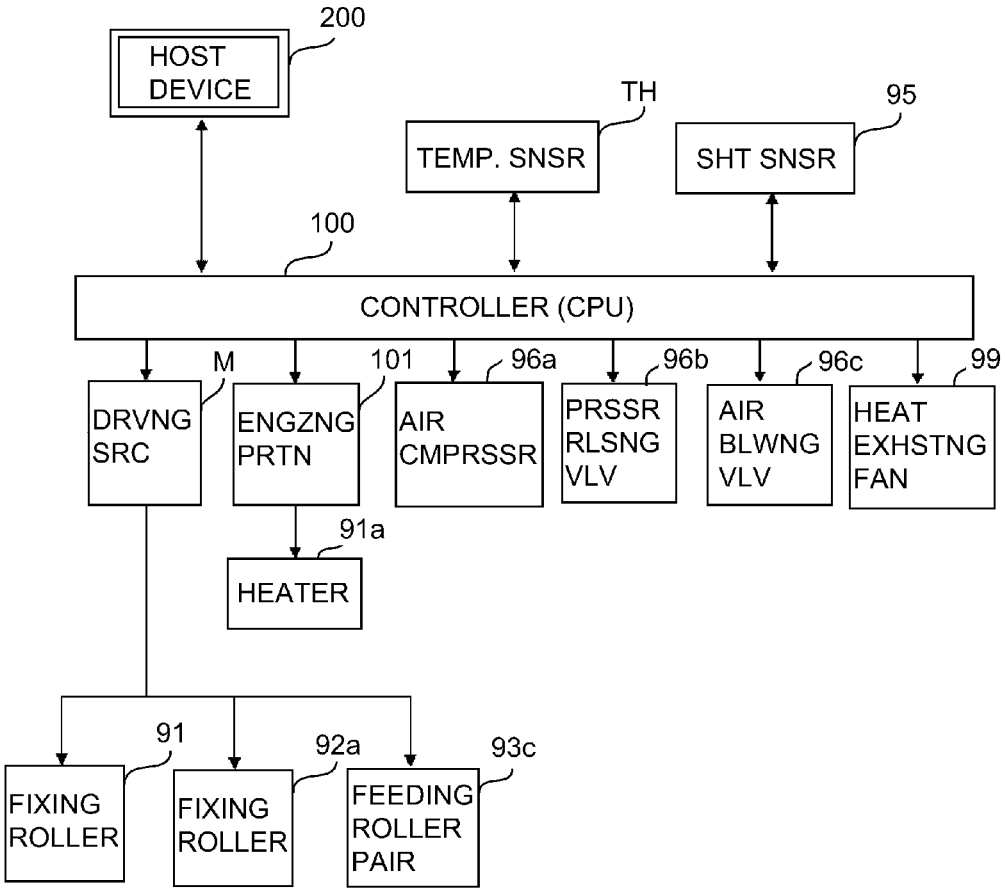
FIG. 4 is a block diagram of a control system.

FIG. 3 is a schematic structural view of an example of an image forming apparatus 1 in which a fixing device 16 according to the present invention is mounted, and FIG. 4 is a block diagram of a control system. The image forming apparatus 1 is a tandem color electrophotographic printer of an intermediary transfer type in which the image forming apparatus 1 is operable on the basis of an image forming job inputted from an external host device 200, such as a personal computer, into a controller 100 and is capable of forming an image on a recording material (sheet) P. A structure of this printer is well known in the art, and therefore, will be described briefly.

An image forming portion 2 includes four image forming units 3 (3C, 3M, 3Y, 3K) and an intermediary transfer belt unit 10. Each of the image forming units 3 includes a photosensitive drum 4, a charger 5, a laser scanner 6, a developing device 7, a primary transfer charger 8, a cleaner 9 and so on, and the image forming units 3C, 3M, 3Y and 3K form toner images of cyan (C), magenta (M), yellow (Y) and black (K), respectively. Then, the four color toner images are successively primary-transferred superposedly from the photosensitive drums 4 of the image forming units 3 onto an intermediary transfer belt 11, so that a full-color toner image is formed on the belt 11.

The toner image is secondary-transferred from the belt 11 onto the sheet P at a secondary transfer nip which is a press-contact portion between the belt 11 and a secondary transfer roller 15. The sheet P is separated and fed one by one from a sheet feeding cassette 12 and is introduced into the secondary transfer nip at predetermined control timing through a feeding path 13 including a registration roller pair 14. Then, the sheet P on which the toner images is transferred is introduced into the fixing device 16, where the toner image is heated and pressed and is fixed on the sheet (recording material) P.

The sheet P which comes out of the fixing device 16 and on which the image has already been fixed passes through an upper surface side of a flapper 17, is introduced to a feeding path 18, and then is discharged onto a tray 19. In the case of double-sided printing, the sheet P which comes out of the fixing device 16 and on which the image has already been formed on the first surface is introduced into a feeding mechanism 20 for double-sided printing by switching of the flapper 17, passes through the feeding path 13 again, and then is fed to the transfer nip in a state in which the sheet P is turned upside down. As a result, the sheet P on which the images are formed on both surfaces is discharged on the tray 19.

[Fixing Device]

Figure 2:
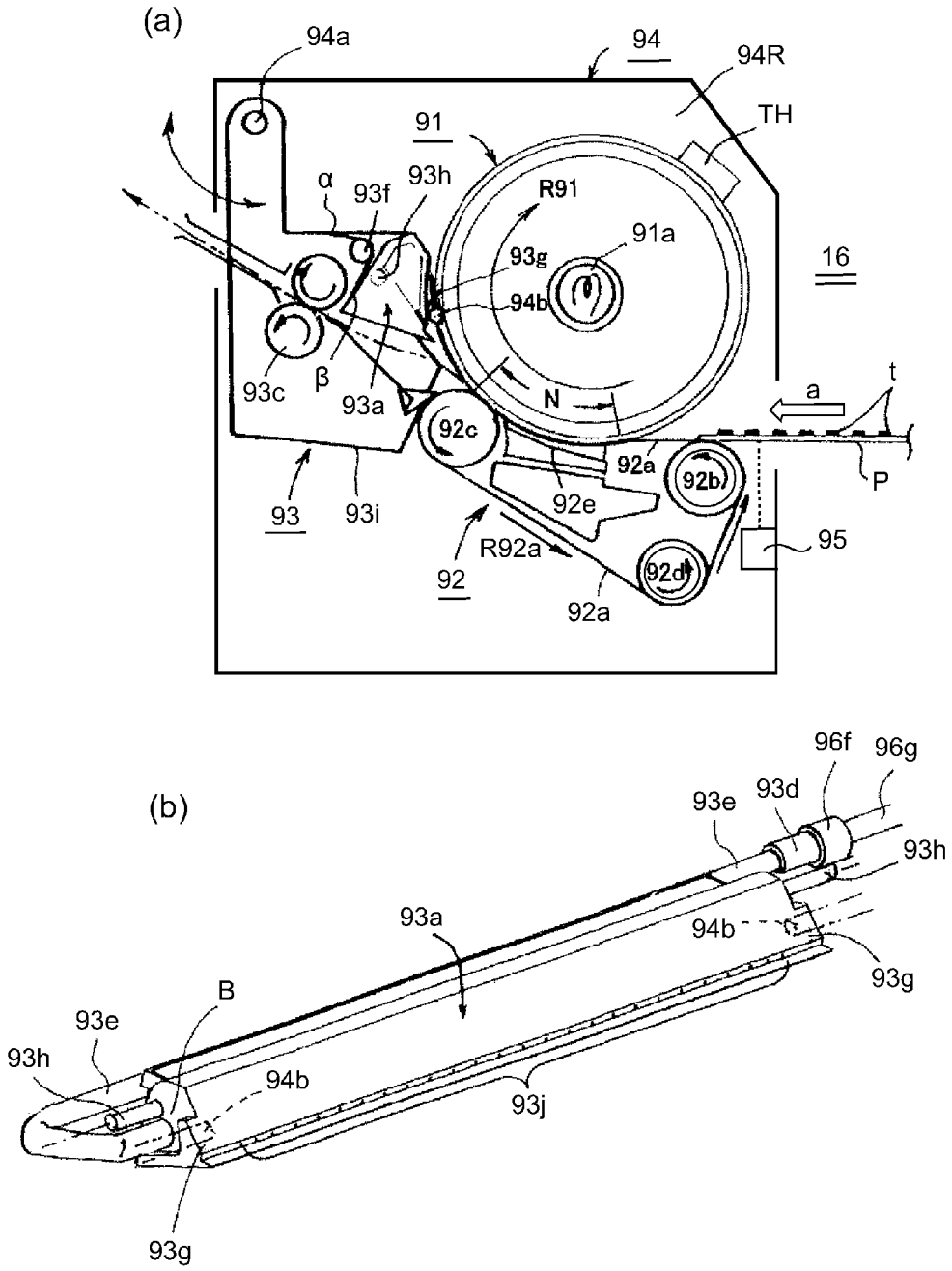
In FIG. 2, (*a*) and (*b*) are structural illustrations of a fixing device in the embodiment.

In FIG. 2, (*a*) is a schematic cross-sectional view of a principal part of the fixing device 16 in this embodiment. The fixing device 16 includes a fixing roller 91 as a first rotatable member, a belt unit 92 including a fixing belt 92*a* as a second rotatable member, forming a nip N in co-operation with the fixing roller 91, a sheet discharging unit 93, and a device frame 94.

(1) Fixing Roller

The fixing roller 91 includes a cylindrical core metal which is 77 mm in outer diameter, 6 mm in thickness and 350 mm in length and which is formed of metal (aluminum in this embodiment). On the core metal, as an elastic layer, a layer of a silicone rubber (JIS-A hardness: 20 degrees in this embodiment) is coated in a thickness of 1.5 mm. On the elastic layer, in order to improve a parting property with the toner, as a heat-resistant parting layer, a layer of fluorine-containing resin (PFA tube in this embodiment) is coated in a thickness of 50 μm.

Figure 1:
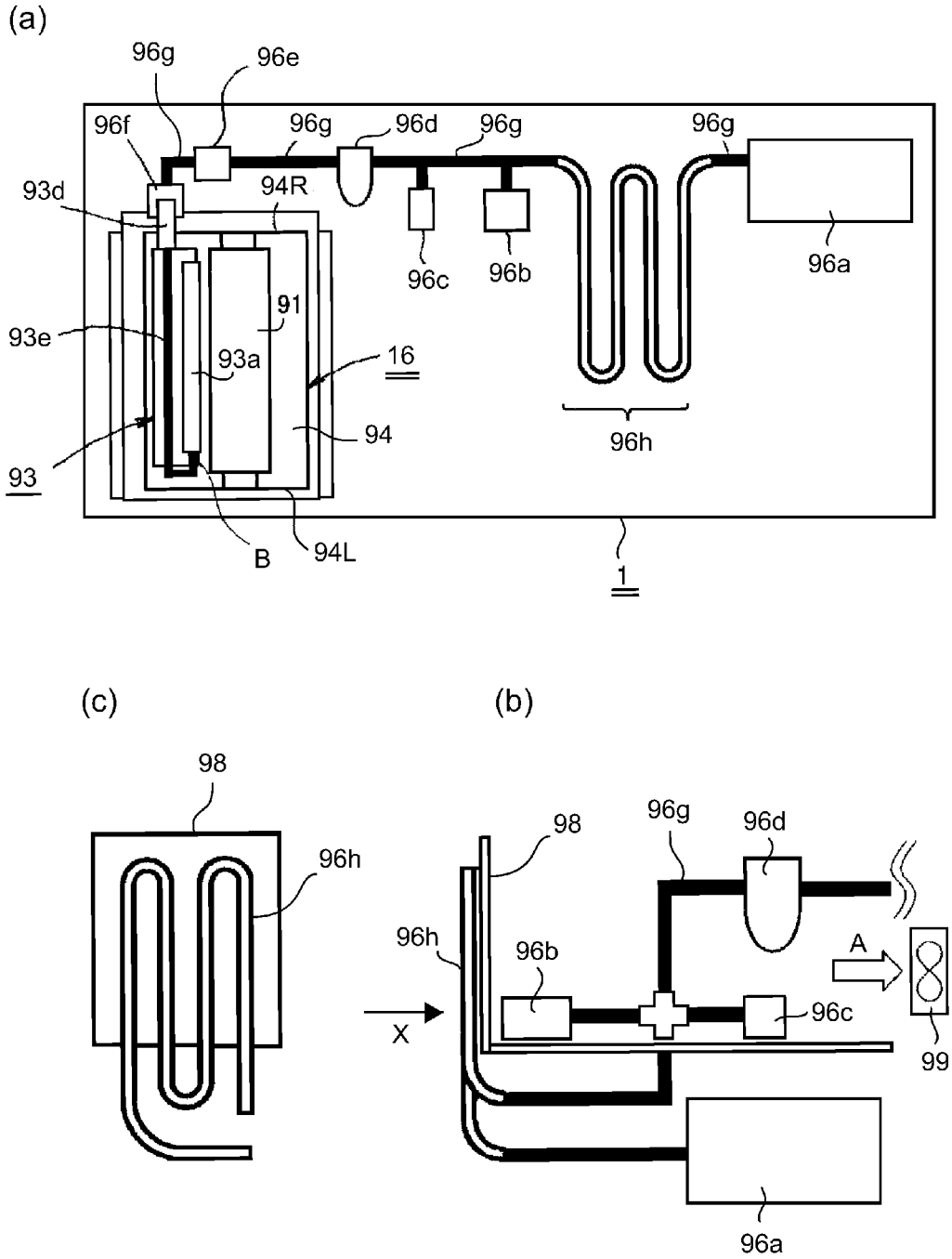
In FIG. 1, (*a*) to (*c*) are illustrations of an air supplying constitution in an embodiment.

The fixing roller 91 is rotatably supported between opposing side plates 94L and 94R of the device frame 94 in one end side (front side) and the other end side (rear side) ((*a*) of FIG. 1). The fixing roller 91 is rotationally driven at a predetermined speed, e.g., at a peripheral speed of 500 mm/sec in the clockwise direction of an arrow R91 by a driving force of a driving source M controlled by the controller 100.

Inside the core metal of the fixing roller 91, as a heat generating member, e.g., a halogen heater 91*a* having rated power of 1200 W is provided. The heater 91*a* generates heat by being supplied with electric power from an electric power supplying portion 101 controlled by the controller 100 and heats the fixing roller 91 from an inside of the fixing roller 91. A surface temperature of the heated fixing roller 91 is detected by a temperature sensor TH such as a thermistor, so that electrical detection temperature information is inputted into the controller 100. On the basis of the inputted detection temperature information, the controller 100 controls the temperature by controlling electric power supplied from the electric power supplying portion 101 to the heater 91*a* so that the surface temperature of the fixing roller 91 is raised and maintained at a predetermined temperature.

(2) Belt Unit

The belt unit 92 is provided under the fixing roller 91 and includes the fixing belt 92*a*, an entrance roller 92*b*, a separation roller 92*c*, a steering roller 92*d* and a pressing pad 92*e*.

The fixing belt 92*a* is a heat-resistant endless belt having flexibility and is formed by coating a 200 μm thick silicone rubber layer on a 100 μm thick polyimide base layer, and is 70 mm in diameter. The fixing belt 92*a* is stretched by the entrance roller 92*b*, the separation roller 92*c*, the steering roller 92*d* and the pressing pad 92*e*. The fixing belt 92*a* is configured to be rotated in the counterclockwise direction of an arrow R92*a* at a peripheral speed substantially corresponding to the rotational speed of the fixing roller 91 by a driving force inputted from the driving source M into the separation roller 92*c*.

The separation roller 92*c* and the pressing pad 92*e* press the fixing belt 92*a* toward the fixing roller 91, so that a broad nip N is formed with respect to a sheet feeding direction a between the fixing roller 91 and the fixing belt 92*a*. In this embodiment, pressure application is effected so that 490 N (50 kgf) is applied to the pressing pad 92*e* and 490 N (50 kgf) is applied to the separation roller 92*c*.

(3) Sheet Discharging Unit

The sheet discharging unit 93 for discharging the sheet P, passed through the nip N, to an outside of the fixing device 16 is provided in a position downstream of the nip N with respect to the sheet feeding direction a. The sheet discharging unit 93 includes a unit frame 93, in which an air nozzle 93*a* as a gas discharging portion for blowing gas for separating the sheet P from the fixing roller 91 and a feeding roller pair 93*c* for discharging the sheet P, separated from the fixing roller 91, to an outside of the fixing device 16 are provided.

The air nozzle 93*a* blows air (gas) toward the fixing roller 91 in order to separate the sheet P, after the sheet P has passed through the nip N, from the fixing roller 91. That is, the air nozzle 93*a* is an air separation mechanism for blowing air to a surface portion of the fixing roller 91 in the neighborhood of a sheet entrance portion of the nip N in a side downstream of the sheet entrance portion with respect to a rotational direction of the fixing roller 91.

The sheet discharging unit 93 (unit frame 93*i*) is mounted rotatably about a supporting shaft 94*a* between the opposing side plates 94L and 94R of the device frame 94. As a result, the sheet discharging unit 93 is movable about the supporting shaft 94*a* between a placement position (state position of FIG. 1) where the fixing device 16 can perform a fixing operation and a retracted position where the sheet discharging unit 93 is largely retracted and moved rearward from the fixing roller 91. The retracted position of the sheet discharging unit 93 is an outside of the device frame 94.

When the sheet P is jammed in the fixing device 16, a user moves the sheet discharging unit 93 to the retracted position. As a result, a downstream side of the fixing device 16 is opened in a degree larger than the nip N, so that clearance (removal) of the jammed paper (sheet) can be facilitated.

In FIG. 2, (*b*) is a perspective view of an outer appearance of the air nozzle 93*a*. In this embodiment, the air nozzle 93*a* is a hollow duct member which is long in a widthwise direction of the fixing roller 91 and which is formed of aluminum. On a surface opposing the fixing roller 91, a plurality of nozzle holes 93*j* of about 0.5-1.0 mm in diameter are provided along a longitudinal direction with predetermined intervals. Into the hollow portion of the air nozzle 93*a*, compressed air is introduced, so that the air is blown from the nozzle holes 93*j* toward the fixing roller 91. An air supplying constitution to the air nozzle 93*a* will be described later.

The air nozzle 93*a* is disposed in parallel to the fixing roller 91, while a side thereof, where the nozzle holes 93*j* are provided, opposes the fixing roller 91, and is supported rotatably about a supporting shaft 93*h* between the opposing side plates in one end side and the other end side of the unit frame 93*i* of the sheet discharging unit 93. Further, the air nozzle 93*a* is urged and rotated about the supporting shaft 93*h* toward the fixing roller 91 by a movable end β of a helical spring 93*f* having a fixed end α.

Positioning pins 94*b* are fixed in the device frame 94 side, and when the sheet discharging unit 93 is moved to the placement position, abutting surfaces 93*g* in the air nozzle 93*a* side abut against the pins 94*b*. As a result, in a state in which the sheet discharging unit 93 is located at the placement position, the air nozzle 93*a* is positioned in a state opposing the fixing roller 91 with a predetermined gap (spacing).

The feeding roller pair 93*c* is, in a state in which the sheet discharging unit 93*a* is located at the placement position, connected with a driving portion (not shown) in the device frame 94 side at a driven portion (not shown) in the sheet discharging unit 93*a* side. Further, the driving force is inputted from the driving source M, whereby the feeding roller pair 93*c* is rotationally driven in a sheet discharging direction at a predetermined peripheral speed. When the sheet discharging unit 93*a* is moved to the retracted position, the driven portion is spaced from the driving portion.

(4) Fixing Operation

In a state in which the fixing roller 91 and the feeding roller pair 93 are rotationally driven and in which the fixing roller 91 is raised and maintained at the predetermined temperature, the sheet P carrying unfixed toner images t is introduced from the image forming portion 2 side into the nip N. The sheet P is nipped and fed through the nip N in contact with the surface of the fixing roller 91 at a toner image carrying surface thereof, so that the toner images t on the sheet (recording material) P are fixed as fixed images on the surface of the sheet P by heat and nip pressure.

The sheet P coming out of the nip N is successively separated from the surface of the fixing roller 91 by pressure (pressing force) of the separation roller 92*c* and is relayed to the feeding roller pair 93*c*, and then is fed and discharged from the fixing device 16. In the case where a basis weight of the sheet P introduced into the fixing device 16 is not less than a predetermined basis weight, as described later, compressed air is introduced into the air nozzle 93*a* at predetermined control timing. As a result, even a sheet having a small basis weight is effectively separated from fixing roller 91 by a separating action by the pressure of the separation roller 92*c* and an air separating action in combination.

(5) Air Supplying Constitution

A constitution of the air supplying mechanism to the air nozzle 93*a* will be described with reference to FIG. 1 and (*b*) of FIG. 2. To a portion B of the air nozzle 93*a* in one end side, an end of an air tube 93*e* is connected, and the air tube 93*e* is extended to the other end of the air nozzle 93*a* via a rear side of the air nozzle 93*a*, and thus is connected to a fixing-side coupler 93*d*. The air tube 93*e* is a tube member consisting of an elastic member. The air tube 93*e* and the fixing-side coupler 93*d* are incorporated in the sheet discharging unit 93, and even when the sheet discharging unit 93 is rotated relative to the device frame 94, the air tube 93*e* consisting of the elastic member does not generate bending and deformation.

In FIG. 1, (*a*) is a schematic view showing a cross-section of the image forming apparatus 1 as seen from above, and shows the fixing device 16 and the air supplying constitution. An air compressor (air pump) 96*a* as a compressed portion for compressing the air is provided. The air compressor 96*a* and the fixing-side coupler 93*d* of the air nozzle 93*a* are connected by a group of pipes constituting a gas flow passage (hereinafter referred to as piping). This group of pipes is constituted by a rubber tube member 96*g* which is an elastic member and a metal pipe member 96*h*.

A terminal of the piping in a side opposite from the air compressor 96*a* side is connected to the fixing-side coupler 93*d* via a main assembly-side coupler 96*f*. The main assembly-side coupler 96*f* is a coupling member for establishing piping connection to the air nozzle 93*a* inside the sheet discharging unit 93 by being connected with the fixing-side coupler 93*d*.

The piping is provided successively with a pressure releasing solenoid (electromagnetic) valve 96*b*, a pressure adjusting valve (relief valve) 96*c*, an air filter 96*d*, and an air blowing solenoid valve 96*e* from an upstream side toward a downstream side of the air flow passage.

The pressure releasing solenoid valve 96*b* is a valve used for releasing air pressure (gas pressure) in the piping and is controlled by the controller 100. The pressure adjusting valve 96*c* is a pressure adjusting portion for adjusting and maintaining the air pressure in the piping at a predetermined pressure. The air filter 96*d* separates, removes, and drains dirt and dust in the piping. The air blowing solenoid valve 96*e* is a switching portion for switching whether or not the air in the piping (gas in the flow passage) adjusted to the predetermined pressure by the pressure adjusting valve 96*c* is opened, and is open/close-controlled by the controller 100.

Of the piping, at least a part of the piping in a section connecting from the air compressor 96*a* to the pressure adjusting valve 96*c* is formed of metal.

In this embodiment, the piping between the air compressor 96*a* and the pressure adjusting valve 96*c* is constituted, as a cooling pipe portion, by a pipe member 96*h* formed of metal, such as aluminum or copper, excellent in thermal conductivity. Other piping portions are constituted by tube members 96*g* consisting of an elastic member.

Figure 5:
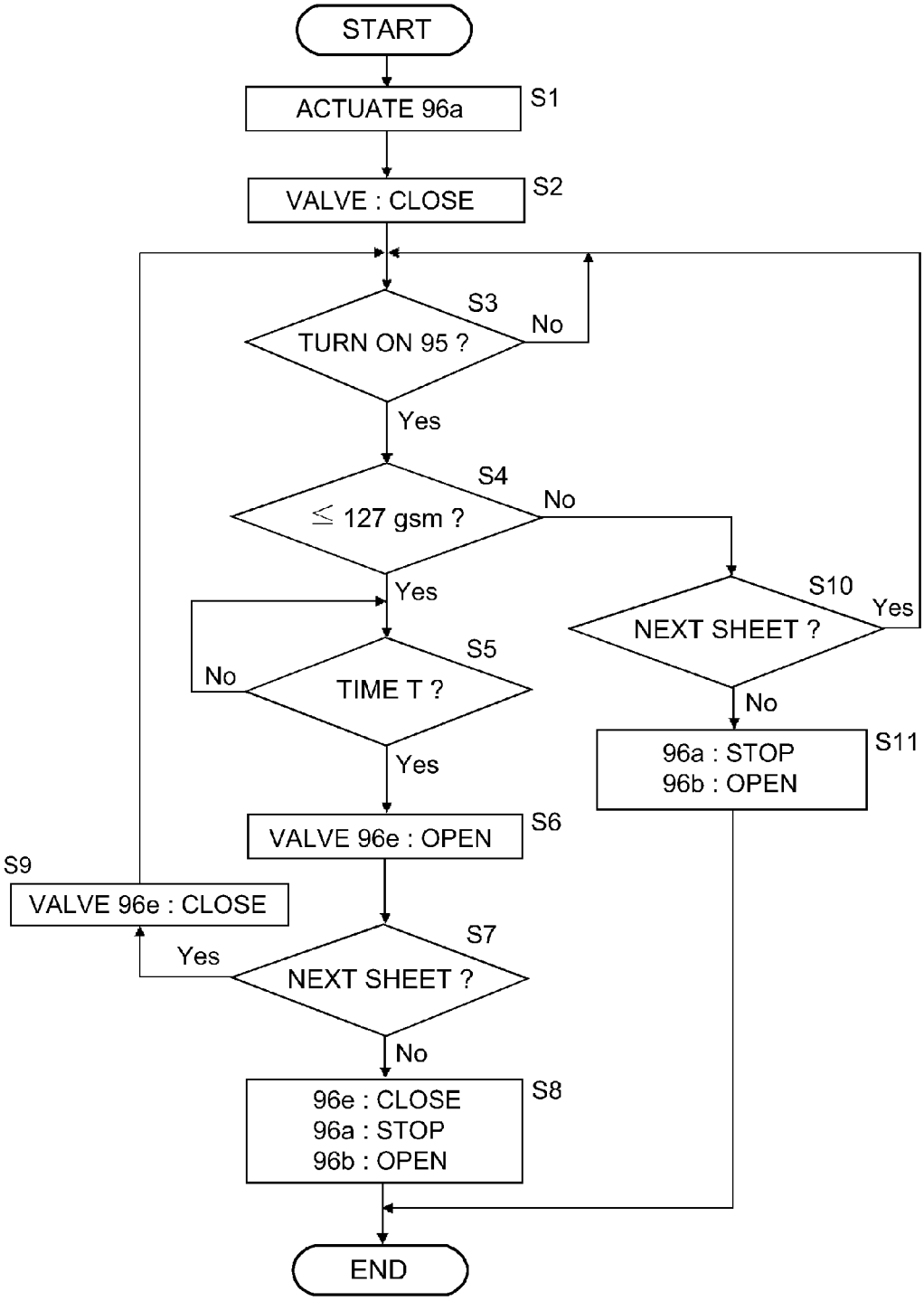
FIG. 5 is a flowchart of control of air supply.

FIG. 5 is a flowchart of control of air supplying to the air nozzle 93*a*. The controller opens the pressure releasing solenoid valve 96*b* and closes the air blowing solenoid valve 96*e* during non-drive of the air compressor 96*a*.

The controller 100 actuates the air compressor 96*a* on the basis of a start signal of an image forming job (S1), and thereafter closes the pressure releasing solenoid valve 96*b* (S2). As a result, cooling gas (compressed air) having a predetermined pressure adjusted by the pressure adjusting valve 96*c* is accumulated in a piping portion from the air compressor 96*a* to the air blowing solenoid valve 96*e*. In this embodiment, the pressure adjusting valve 96*c* is adjusted so that the pressure in the piping is 0.2-0.3 MPa.

When the image forming portion 2 performs an image forming operation and the sheet P is sent into the fixing device 16, a sheet sensor (recording material detecting means) 95 provided at a sheet entrance portion of the fixing device 16 is turned on by detecting that a leading end of the sheet P reaches the sheet entrance portion (S3). The sheet sensor 95 is turned off by passing of a trailing end of the sheet P through the sheet entrance portion.

In the case where the sheet P introduced in the fixing device 16 has the basis weight not more than a predetermined basis weight (not more than 127 gsm in this embodiment) for which air separation of the sheet P is required, on the basis of turning-on timing of the sheet sensor 95, the controller opens the air blowing solenoid valve 96*e* after a lapse of a predetermined time T (S4-S6).

In this embodiment, the basis weight of the sheet P sent into the fixing device 16 is recognized from information, of a species of the sheet P used, contained in information of the image forming job sent from the host device 200. Further, the predetermined time is a time required until the sheet P detected by the sheet sensor 95 at the leading end thereof is further fed and the leading end reaches a sheet exit portion of the nip N.

The air blowing solenoid valve 96*e* is opened at control timing as described above, so that the compressed air is blown to the reading end of the sheet P, and comes out of the sheet exit portion of the nip N at a speed of about 300 m/sec. As a result, even the sheet having the small basis weight is effectively separated by the separating action of the pressure by the separation roller 92*c* and the air separating action in combination. The air blowing from the air nozzle 93*a* is continued until the sheet P completely passes through the nip N in this embodiment.

When there is no subsequent sheet, the controller 100 closes the air blowing solenoid valve 96*e*, stops the drive of the air compressor 96*a* and opens the pressure releasing solenoid valve 96*b* (S7, S8). Further, in the step S7, in the case where there is a subsequent sheet, the controller 100 closes the air blowing solenoid valve 96*e* (S9), and the sequence returns to the step S3.

In the step S4, in the case where the basis weight of the sheet P sent into the fixing device 16 is more than the predetermined basis weight, in this embodiment, the air separation of the sheet P is not needed, and the fixing operation is performed without supplying the air to the air nozzle 93*a*. Further, when there is no subsequent sheet, the controller 100 stops the drive of the air compressor 96*a* and opens the pressure releasing solenoid valve 96*b* (S10, S11). When there is a subsequent sheet in the step S10, the sequence returns to the step S3.

Here, as described above, the gas introduced into the piping by the drive of the air compressor 96*a* is a high-temperature gas by heat of compression. Further, when the temperature of the compressed gas in the piping is in a high state such that the temperature is, e.g., not less than 100° C., there is a liability that air pressure (pneumatic) parts such as the pressure releasing solenoid valve 96*b*, the pressure adjusting valve 96*c* and the air filter 96*d* are damaged. Or, there is a liability that a behavior of a valve body when the air passes through the inside of the pressure adjusting valve 96*c* causes an abnormality and thus a high-frequency noise is caused when the valve body hits a (valve) seat.

In order to suppress this noise, in this embodiment, as described above, the piping between the air compressor 96*a* and the pressure releasing solenoid valve 96*b* is constituted by the pipe member 96*h* formed of metal as the cooling pipe portion. By this constitution, the high-temperature air introduced into the piping by the drive of the air compressor 96*a* is efficiently cooled during passing thereof through the inside of the pipe member 96*h*, so that the temperature of the air flowing into the air pressure parts is not more than 60° C.

In order to sufficiently cool the compressed air, the pipe member 96*h* as the cooling pipe portion is required to have an air flow passage length to some extent. In this embodiment, the pipe member 96*h* (the air flow passage) is provided with a plurality of U-shaped flexed portions (hairpin portions) (hereinafter referred to as a serpentine portion). As a result, the piping having a long flow passage can be accommodated in a narrow space, so that it is possible to suppress upsizing of the image forming apparatus.

Mounting constitutions of the pipe member 96*h* and other air pressure parts are specifically shown in (*b*) and (*c*) of FIG. 1. The serpentine portion of the pipe member 96*h* is formed so that an axial center line of the pipe substantially exists on a single flat surface. This serpentine portion is hermetically fixed by a fixing member (spring member) to a flat surface portion of a partitioning plate 98 (metal partitioning plate in a casing of the image forming apparatus) as a heat dissipating member having a surface substantially parallel to this flat surface. The partitioning plate 98 is formed of metal, and therefore, the partitioning plate 98 is used as an object to be subjected to heat conduction (heat dissipating member), so that heat can be efficiently taken from the compressed air.

Further, a fan 99 is provided in a side opposing the flat surface portion of the partitioning plate 98 via the pressure releasing solenoid valve 96*b* and the pressure adjusting valve 96*c*. The fan 99 generates an air stream in an arrow A in (*b*) of FIG. 1, so that the heat in the casing (space) of the image forming apparatus is dissipated (discharged) to the outside of the casing. By providing the fan 99 at a position opposing the partitioning plate 98 which is liable to accumulate the heat, the temperature of the compressed air can be lowered further efficiently. Also a constitution in which a heat dissipating fin is provided along a longitudinal direction of the pipe member 96*h* at an outer peripheral portion of the pipe member 96*h* is effective. In the following numerical value examples and numerical value ranges will be shown.

a: Piping length of member pipe (piping) 96: 2000 mm, preferably not less than 1000 mm in view of cooling efficiency of the compressed air.

b: Outer configuration of metal pipe 96*h:* 10 mm, preferably not more than 30 mm in view of the cooling efficiency of the compressed air.

c: Inner diameter of metal pipe 96*h:* 7 mm.

d: Piping length from pump 96*a* to relief valve 96*c* (metal piping+rubber piping): 4000 mm, it is desirable that a ratio of a length of the metal piping to a length of the piping from the pump 96*a* to the relief valve 96*c* is not less than 40%, preferably not less than 50%.

The metal piping 96*h* is high in cooling performance compared with a metal tank. The metal piping 96*h* is high in flexibility of a designed shape compared with the metal tank. Inside the metal piping 96*h*, water does not readily accumulate. The piping other than the metal piping 96*h* is a rubber tube, and therefore, absorbs vibration of the fixing device during valve opening. The piping other than the metal piping 96*h* is the rubber tube and thus is high in degree of freedom of piping (pipe arrangement).

As described above, the part 96*h* of the piping (gas flow passage) is formed of metal (metal pipe) excellent in thermal conductivity, so that the high-temperature gas compressed by the air compressor 96*a* is efficiently cooled until the gas reaches a position where the air pressure parts are provided. For that reason, in comparison with placement of the pressure tank, it is possible to suppress temperature rise of the pressure adjusting valve 96*c* and other air pressure parts 96*b*, 96*d* and 96*e* which are provided in the piping while remarkably maintaining a space saving property. Accordingly, a phenomenon that the pressure adjusting valve 96*c* generates the noise can be suppressed, and it is possible to decrease a risk of breakage of the pressure adjusting valve 96*c* and other air pressure parts 96*b*, 96*d* and 96*e*.

Incidentally, even when the flow passage length from the air compressor 96*a* to the pressure adjusting valve 96*c* is made long without using the metal pipe (piping) 96*h*, a certain effect of suppressing the temperature rise of the pressure adjusting valve 96*c* is obtained. However, a flow passage for that purpose becomes very long, so that a space necessary to ensure the flow passage increases and thus leads to upsizing of the fixing device.

<Other Embodiments>

1) In the above described embodiment, the device for heating and fixing the unfixed toner images formed on the recording material was described as an example of the fixing device according to the present invention, but the present invention is also similarly applicable to the following device. For example, the present invention is applicable to a device for increasing a gloss (glossiness) of an image by heating and fixing again a toner image which is temporarily fixed on a recording material (herein, the device is referred to as the fixing device also in this case). Further, the present invention is also applicable to a device for fixing a toner image by pressure.
2) It is also possible to employ a device constitution in which the fixing belt 92*a* is used as a first rotatable member and the air for separating the sheet is blown to the fixing belt 92*a*, and a device constitution in which the air for separating the sheet is blown to both of the fixing roller 91 and the fixing belt 92*a*.
3) It is also possible to employ a fixing device constitution in which both of the first and second rotatable members are rollers, and a fixing device constitution in which both of the first and second rotatable members are endless belts.
4) The gas includes other gases, such as nitrogen gas and carbonic acid gas, other than the air.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-136939 filed on Jul. 8, 2015, which is hereby incorporated by reference herein in its entirety.

What is claimed is:

1. An image heating apparatus comprising:

first and second rotatable members configured to form a nip for heating a toner on a sheet;

a compressor;

an air nozzle configured to blow air, which is compressed by said compressor, to said first rotatable member; and a supplying mechanism configured to supply the air, which is compressed by said compressor, to said air nozzle, wherein said supplying mechanism includes a pressure adjusting valve configured to adjust an inside pressure and a metal pipe, including a plurality of substantially U-shaped pipe portions, configured to form at least a part of an air supply passage from said compressor to said pressure adjusting valve.

2. An image heating apparatus according to claim 1, further comprising a heat dissipating plate and a member configured to bring said metal pipe into close contact with said heat dissipating plate.

3. An image heating apparatus according to claim 2, wherein said heat dissipating plate is formed of metal.

4. An image heating apparatus according to claim 2, further comprising a fan configured to cool said heat dissipating plate.

5. An image heating apparatus according to claim 1, wherein a length of the part of the air supplying passage formed by said metal pipe is not less than 40% of a length of the air supplying passage from said compressor to said pressure adjusting valve.

6. An image heating apparatus according to claim 5, wherein said supplying mechanism includes a rubber pipe.

7. An image heating apparatus according to claim 1, wherein a length of the part of the air supplying passage formed by said metal pipe is not less than 50% of a length of the air supplying passage from said compressor to said pressure adjusting valve.

8. An image heating apparatus according to claim 7, wherein said supplying mechanism includes a rubber pipe.

9. An image heating apparatus according to claim 1, wherein said metal pipe dissipates the air so that a temperature of the air reaching said pressure adjusting valve is not more than 60° C.

10. An image heating apparatus according to claim 1, wherein said supplying mechanism includes a valve configured to switch whether or not the air, which is adjusted by said pressure adjusting valve so that a pressure thereof is not more than a predetermined pressure, is blown to said first rotatable member.

11. An image heating apparatus according to claim 10, further comprising a controller configured to control switching of said valve, wherein said controller effects control so that when a sheet having a first basis weight passes through the nip, the air adjusted by said pressure adjusting valve so that the pressure thereof is not more than the predetermined pressure is blown to said first rotatable member, and so that when a sheet having a second basis weight larger than the first basis weight passes through the nip, the air, which is adjusted by said pressure adjusting valve so that the pressure thereof is not more than the predetermined pressure, is not blown to said first rotatable member.

12. An image heating apparatus comprising:

first and second rotatable members configured to form a nip for heating a toner on a sheet;

a compressor;

an air nozzle configured to blow air, which is compressed by said compressor, to said first rotatable member; and a supplying mechanism configured to supply the air, which is compressed by said compressor, to said air nozzle, wherein said supplying mechanism includes a pressure adjusting valve configured to adjust an inside pressure and a metal pipe portion, including a plurality of substantially U-shaped pipe portions, configured to form at least a part of an air supply passage from said compressor to said pressure adjusting valve.

13. An image heating apparatus according to claim 12, wherein a length of the part of the air supplying passage formed by said metal pipe portion is not less than 40% of a length of the air supplying passage from said compressor to said pressure adjusting valve.

14. An image heating apparatus according to claim 13, wherein said supplying mechanism includes a rubber pipe.

15. An image heating apparatus comprising:

first and second rotatable members configured to form a nip for heating a toner on a sheet;

a compressor;

an air nozzle configured to blow air, which is compressed by said compressor, to said first rotatable member;

a supplying mechanism configured to supply the air, which is compressed by said compressor, to said air nozzle, wherein said supplying mechanism includes a pressure adjusting valve configured to adjust an inside pressure and a metal pipe configured to form at least a part of an air supply passage from said compressor to said pressure adjusting valve;

a heat dissipating plate; and a member configured to bring said metal pipe into close contact with said heat dissipating plate.

16. An image heating apparatus according to claim 15, wherein said heat dissipating plate is formed of metal.

17. An image heating apparatus according to claim 15, further comprising a fan configured to cool said heat dissipating plate.

18. An image heating apparatus according to claim 15, wherein a length of the part of the air supplying passage formed by said metal pipe is not less than 40% of a length of the air supplying passage from said compressor to said pressure adjusting valve.

19. An image heating apparatus according to claim 18, wherein said supplying mechanism includes a rubber pipe.

20. An image heating apparatus according to claim 15, wherein a length of the part of the air supplying passage formed by said metal pipe is not less than 50% of a length of the air supplying passage from said compressor to said pressure adjusting valve.

21. An image heating apparatus according to claim 20, wherein said supplying mechanism includes a rubber pipe.

22. An image heating apparatus according to claim 15, wherein said metal pipe dissipates the air so that a temperature of the air reaching said pressure adjusting valve is not more than 60° C.

23. An image heating apparatus according to claim 15, wherein said supplying mechanism includes a valve configured to switch whether or not the air, which is adjusted by said pressure adjusting valve so that a pressure thereof is not more than a predetermined pressure, is blown to said first rotatable member.

24. An image heating apparatus according to claim 23, further comprising a controller configured to control switching of said valve, wherein said controller effects control so that when a sheet having a first basis weight passes through the nip, the air, which is adjusted by said pressure adjusting valve so that the pressure thereof is not more than the predetermined pressure, is blown to said first rotatable member, and so that when a sheet having a second basis weight larger than the first basis weight passes through the nip, the air, which is adjusted by said pressure adjusting valve so that the pressure thereof is not more than the predetermined pressure, is not blown to said first rotatable member.

* * * * *